US006708409B2

(12) United States Patent
Yu

(10) Patent No.: US 6,708,409 B2
(45) Date of Patent: Mar. 23, 2004

(54) CIGAR CUTTING DEVICE

(76) Inventor: Chin-Tung Yu, No. 70, Ping An Rd., Hou Li Shiang, Taichung Hsien (TW)

( * ) Notice: Subject to any disclaimer, the term of this patent is extended or adjusted under 35 U.S.C. 154(b) by 0 days.

(21) Appl. No.: 10/115,114

(22) Filed: Apr. 4, 2002

(65) Prior Publication Data

US 2003/0188433 A1 Oct. 9, 2003

(51) Int. Cl.[7] ..... A24F 13/24
(52) U.S. Cl. ..... 30/113; 30/111; 131/253
(58) Field of Search ..... 30/111, 112, 113, 30/90.1, 232, 221, 298, 296.1, 341, 110, 109; 131/258, 248, 250, 253, 252

(56) References Cited

U.S. PATENT DOCUMENTS 324,281 A * 8/1885 Veit
522,076 A * 6/1894 Miller
835,912 A * 11/1906 Obermayer
950,692 A * 3/1910 Garrigus
1,314,759 A * 9/1919 Silvernail
6,164,286 A * 12/2000 Schad

* cited by examiner

*Primary Examiner*—Hwei-Siu Payer
(74) *Attorney, Agent, or Firm*—Collard & Roe, P.C.

(57) ABSTRACT

A cigar cutting device includes a body with an aperture for an insertion of an end of a cigar, and two blades are movably inserted in two open ends of the body. A first end of each of the blades is located in the aperture and a base is connected to a second end of each of the blades. A holding ring is rotatably connected to each of the two bases.

5 Claims, 6 Drawing Sheets

CIGAR CUTTING DEVICE

FIELD OF THE INVENTION

The present invention relates to a cigar cutting device that has two rotatable holding rings and two assist members can be pivoted from the ring so that the user may use three fingers to cut the cigar.

BACKGROUND OF THE INVENTION

A conventional cigar cutting device is shown in FIG. 6 and includes a body 10 with two blades 11 movably engaged two open ends of the body 10. Each blade 11 has a holding ring 13 and an aperture 12 is defined through the body 10 so that an end of a cigar is inserted in the aperture 12. The user may insert a finger in each of the rings 13 to move the two blades 11 toward each other to cut the cigar. In order to check how long of the cigar is to be cut, the user has to turn the cutting device to see how much length of the end of the cigar extends from the other side of the body 10. This is inconvenient for the user because the hand which has two fingers in the holding rings is also rotated. Besides, when the end of the cigar to be cut is stiff and hard to cut, the fingers are suffered by high pressure. Furthermore, there is a gap between the two blades 11 and when the two blades 11 cut the cigar from two opposite directions, the gap reduces the efficiency of the cut.

SUMMARY OF THE INVENTION

The present invention relates to a cigar cutting device and includes a body having an aperture and two blades are movably inserted in two open ends of the body. A first end of each of the blades is located in the aperture and a base is connected to a second end of each of the blades. A holding ring is rotatably connected to each of the two bases.

The primary object of the present invention is to provide a cigar cutting device wherein the holding fingers are rotatable relative to the body.

Another object of the present invention is to provide a cigar cutting device wherein the holding ring has two assist members so that the user may use three fingers to operate the holding ring.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
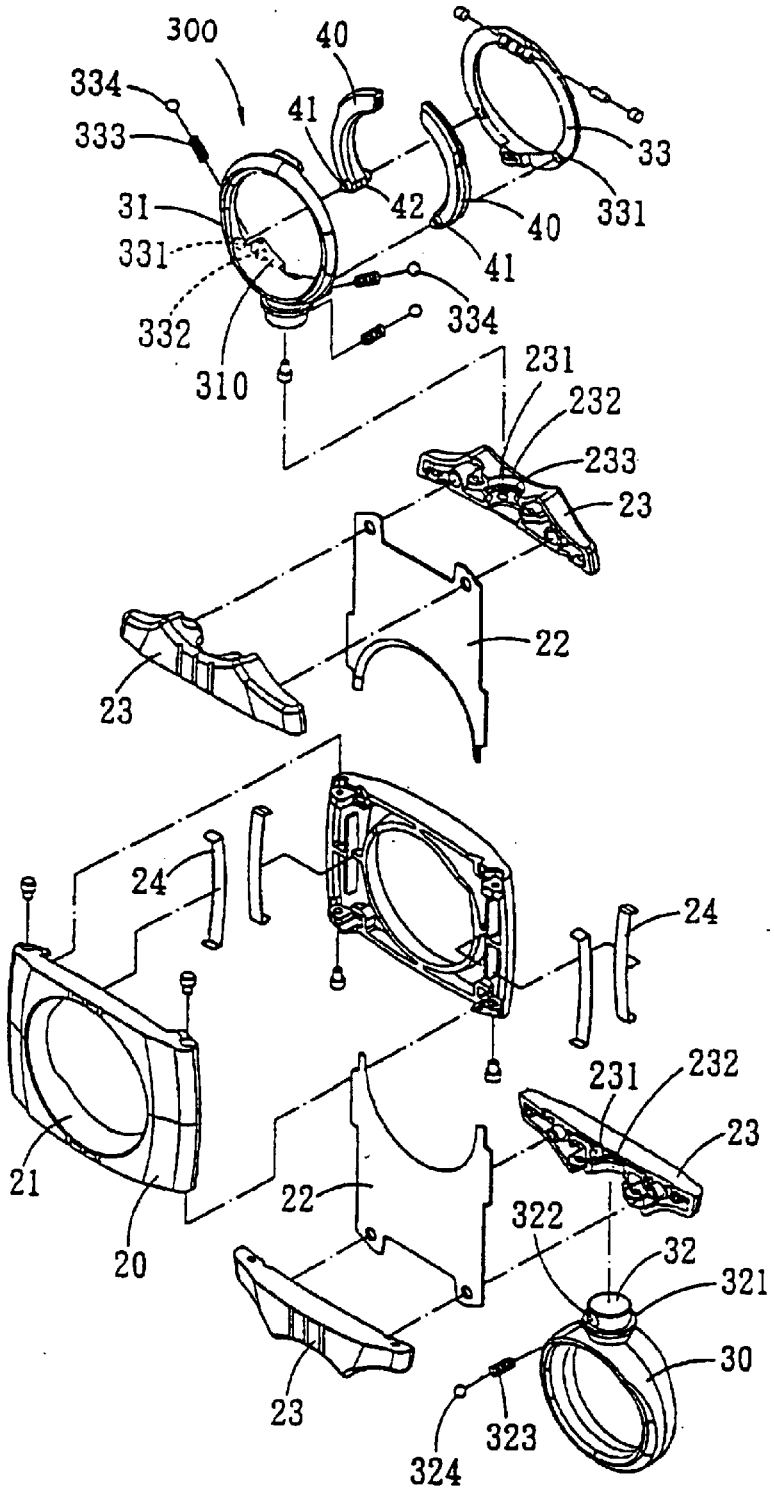
FIG. 1 is an exploded view to show the cigar cutting device of the present invention.
Figure 2:
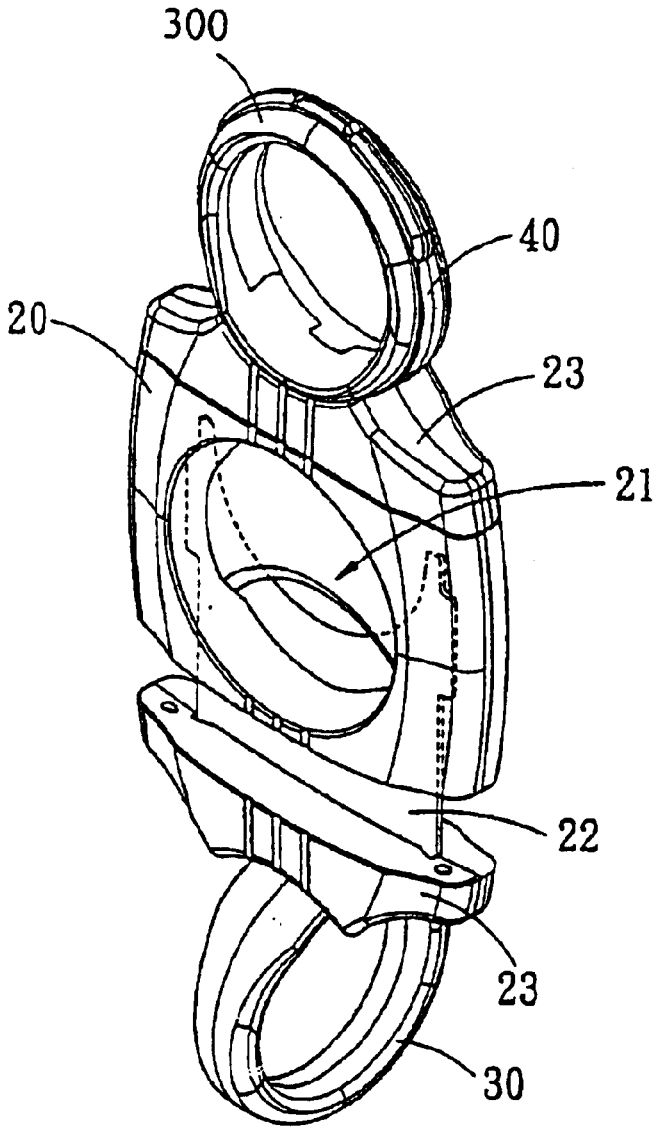
FIG. 2 is a perspective view to show the cigar cutting device of the present invention.
Figure 3:
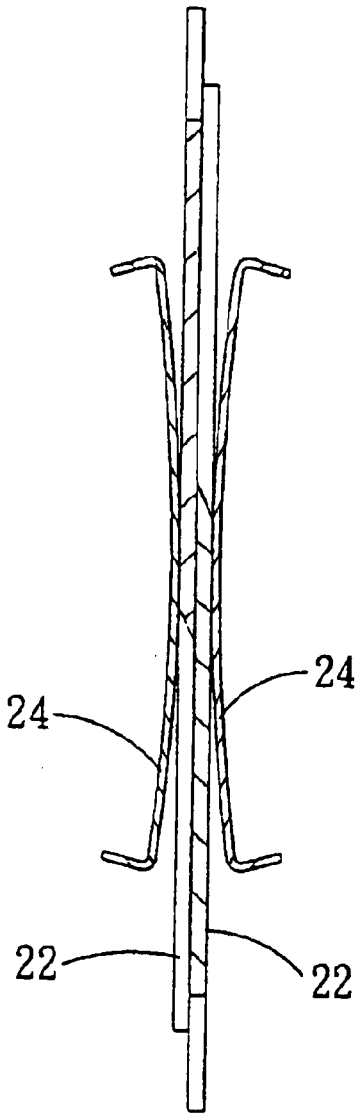
FIG. 3 shows that the two sides of the two blades of the cigar cutting device are urged between two urging plates.

Referring to FIGS. 1 and 2, the cigar cutting device of the present invention comprises a body 20 which is composed of two parts and an aperture 21 is defined through the body 10. Two blades 22 are movably inserted in two open ends of the body 20 and a first end of each of the blades 22 is located in the aperture 21. Two pairs of urging plates 24 are connected to a periphery of the aperture 21 in the body 20 and two sides of the two blades 11 are inserted between the two gaps of the two pairs of urging plates 24 as shown in FIG. 3 so that the two blades 22 are close together when cutting.

A base 23 is connected to a second end of each of the blades 22. A first holding ring 30 and a second holding ring 300 are respectively and rotatably connected to the two bases 23. Each of the first holding ring 30 and the second holding ring 300 has an insertion 32 which is rotatably inserted in the opening 232. A flange 321 extends radially from each of the insertions 32 and is sized to be rotatably engaged with a recessed area 231 in the opening 232 so that the insertions 32 will not be disengaged from the openings 232.

Each of the insertions 32 has a recess 322 defined radially therein and a spring 323 and a bead 324 are received in the recess 322. A plurality of dents 233 are defined in an inside of the opening 232 of each of the bases 23 and the bead 324 is engaged with one of the dents 233. Therefore, when an end of a cigar (not shown) is inserted in the aperture 21, the user simply rotates the cigar to let the body 20 be rotated between the two holding rings 30, 300 so that he/she can check the length to be cut of the cigar.

Figure 4:
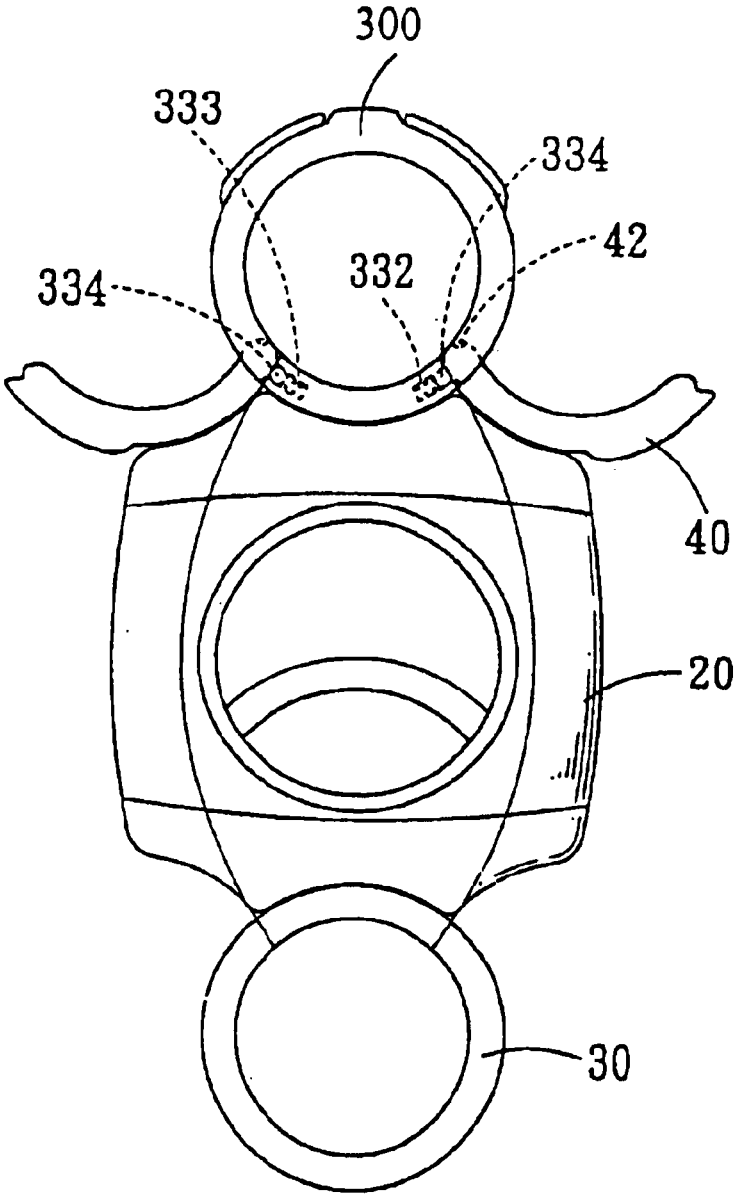
FIG. 4 shows two assist members are pivotably connected to the holding ring of the cigar cutting device of the present invention.
Figure 5:
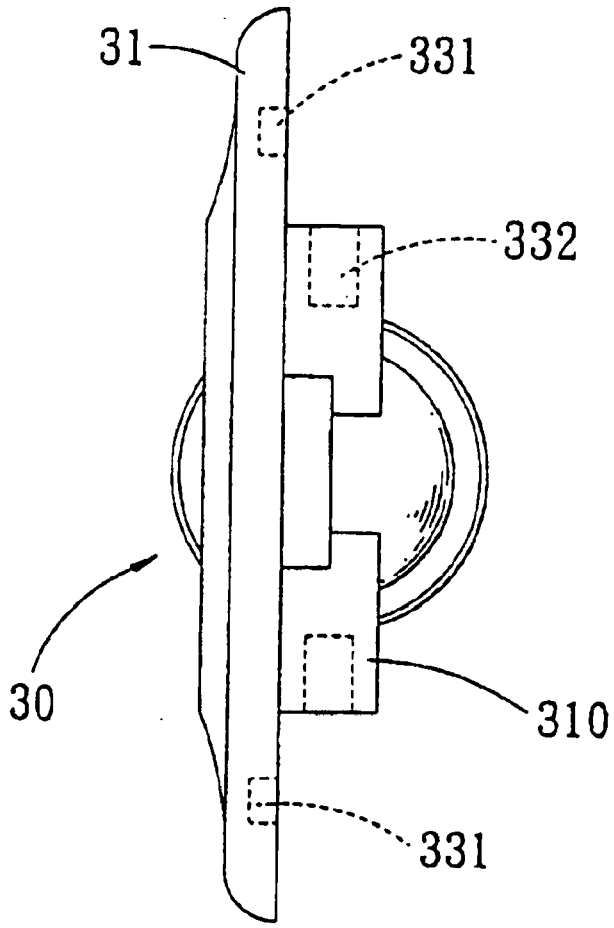
FIG. 5 shows the two halves of the holding ring for being engaged with the two assist members.
Figure 6:
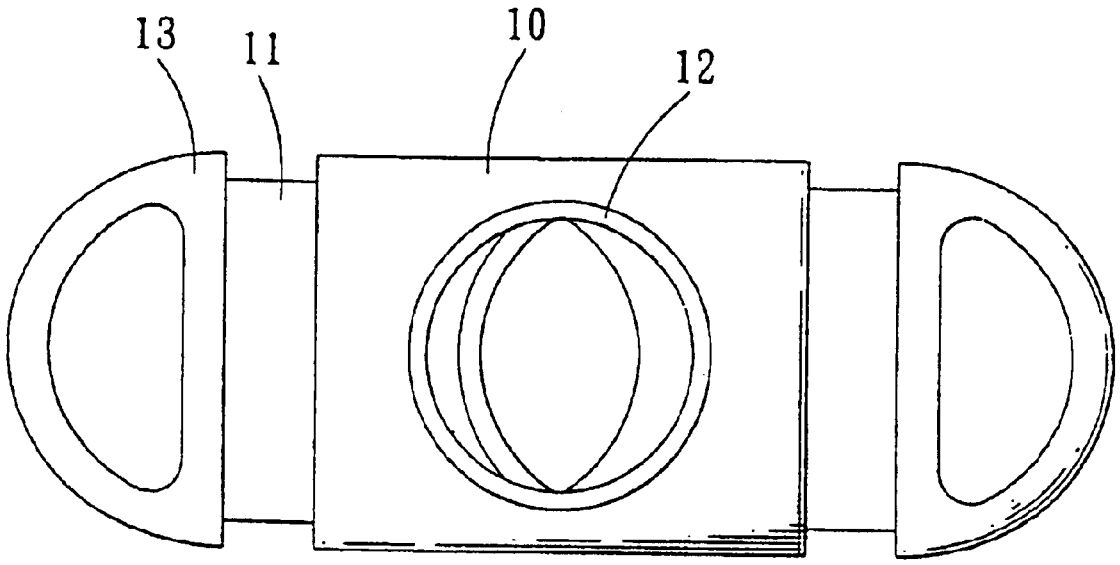
F I G. 6 PRIOR ART
FIG. 6 shows a conventional cigar cutting device.

Referring to FIGS. 4 and 5, two assist members 40 are pivotally connected two an outer periphery of the second holding ring 300. Each of the assist member 40 has a shaft 41 at an end thereof and the second holding ring 300 is composed of two ring-shaped halves 31, 33. The shaft 41 are engaged with two respective holes 331 in the two halves 31, 33 so that the two assist members 40 are engaged between which the two halves 31, 33 of the second holding ring 30 as shown in FIG. 2. A positioning recess 42 is defined in each of the two respective ends of the two assist members 40. The half 31 has a protrusion portion 310 and two recesses 332 are respectively defined in two ends of the protrusion portion 310. Each of the two recesses 332 has a spring 333 and a bead 334 received therein and the beads 334 are engaged with the positioning recesses 42 when the two assist members 40 are not pivoted outward. Therefore, when the two assist members are pivoted outward, the user may use three fingers to operate the second holding ring 300.

While we have shown and described the embodiment in accordance with the present invention, it should be clear to those skilled in the art that further embodiments may be made without departing from the scope of the present invention.

What is claimed is:

1. A cigar cutting device comprising:

a) a body comprising:

i) two open ends;

ii) an aperture defined there through; and iii) two pairs of urging plates disposed in said body at a periphery of said aperture;

b) two blade assemblies, each comprising:

i) a blade movably inserted in one of said two open ends of said body, wherein said blade has a first end and a second end and wherein said first end of said blade is disposed in said aperture; and ii) a base connected to said second end of said blade, wherein said base has an opening therein and a plurality of dents disposed on an inside surface of said opening;

c) a first holding ring and a second holding ring rotatably connected to said base, said first and second holding rings each comprising:
   i) an insertion rotatably inserted in said opening of said base;
   ii) a flange extending radially from said insertion and rotatably engaged within said opening of said base;
   iii) a recess disposed radially on said insertion;
   iv) a spring received in said recess disposed radially on said insertion; and
   v) a bead received in said recess disposed radially on said insertion, wherein said bead is engaged with one of said plurality of dents;

wherein said second holding ring has two halves and additionally comprises:
   i) two assist members pivotally connected to an outer periphery of said second holding ring between said two halves;
   ii) a positioning recess disposed on an end of each of said two assist members;
   iii) a protrusion portion connected to one of said two halves of said second holding ring, wherein said protrusion portion has two ends;
   iv) a recess disposed at each of said two ends of said protrusion portion;
   v) a spring received in said recess disposed at each of said two ends of said protrusion portion; and
   vi) a bead received in said recess disposed at each of said two ends of said protrusion portion;

wherein said two pairs of urging plates form a gap for receiving each of said first ends of said blades; and wherein said bead received in said recess disposed at each of said two ends of said protrusion portion is engaged with said assist member when said assist member is engaged between said two halves of said second holding ring.

2. A cigar cutting device comprising:

a) a body comprising:
   i) two open ends; and
   ii) an aperture defined there through;

b) two blade assemblies, each comprising:
   i) a blade movably inserted in one of said two open ends of said body, wherein said blade has a first end and a second end and wherein said first end of said blade is disposed in said aperture; and
   ii) a base connected to said second end of said blade, wherein said base has an opening therein; and c) a first holding ring and a second holding ring rotatably connected to said base, said first and second holding rings each comprising:
   i) an insertion rotatably inserted in said opening of said base; and
   ii) a flange extending radially from said insertion and rotatably engaged within said opening of said base.

3. The cigar cutting device according to claim 2, further comprising:

a plurality of dents disposed on an inside surface of said opening of said base;

a recess disposed radially on said insertion;

a spring received in said recess; and a bead received in said recess;

wherein said bead is engaged with one of said plurality of dents.

4. A cigar cutting device comprising:

a) a body comprising:
   i) two open ends; and
   ii) an aperture defined there through;

b) two blade assemblies, each comprising:
   i) a blade movably inserted in one of said two open ends of said body, wherein said blade has a first end and a second end and wherein said first end of said blade is disposed in said aperture; and
   ii) a base connected to said second end of said blade;

c) a first holding ring rotatably connected to one of said bases; and d) a second holding ring rotatably connected to the other of said bases, wherein said second holding ring comprises two assist members pivotally connected to an outer periphery of said second holding ring.

5. The cigar cutting device according to claim 4, wherein said second holding ring has two halves and wherein said two assist members are pivotally engaged between said two halves, said cigar cutting device further comprising:

a positioning recess disposed on an end of each of said two assist members;

a protrusion portion connected to one of said two halves of said second holding ring, wherein said protrusion portion has two ends;

a recess disposed at each of said two ends of said protrusion portion;

a spring received in said recess disposed at each of said two ends of said protrusion portion; and a bead received in said recess disposed at each of said two ends of said protrusion portion;

wherein said bead received in said recess disposed at each of said two ends of said protrusion portion is engaged with said assist member when said assist member is engaged between said two halves of said second holding ring.

* * * * *